United States Patent [19]

Bouquet

[11] Patent Number: 5,076,585

[45] Date of Patent: Dec. 31, 1991

[54] WOOD GOLF CLUBHEAD ASSEMBLY WITH PERIPHERAL WEIGHT DISTRIBUTION AND MATCHED CENTER OF GRAVITY LOCATION

[76] Inventor: Harry Bouquet, 13582 Mindora Ave., Sylmar, Calif. 91342

[21] Appl. No.: 702,183

[22] Filed: May 20, 1991

Related U.S. Application Data

[63] Continuation-in-part of Ser. No. 629,699, Dec. 17, 1990, abandoned, and a continuation-in-part of Ser. No. 351,835, May 15, 1989, abandoned.

[51] Int. Cl.[5] ..... A63B 53/04

[52] U.S. Cl. ..... 273/167 F; 273/169; 273/171; 273/173

[58] Field of Search ..... 273/77 R, 77 A, 167–175, 273/194 B

[56] References Cited

U.S. PATENT DOCUMENTS

| | | | |
|---|---|---|---|
| 1,840,451 | 1/1932 | Jansky | 273/173 |
| 2,056,335 | 10/1936 | Wettlaufer | 273/173 X |
| 3,084,940 | 4/1963 | Cissel | 273/173 |
| 3,695,618 | 10/1972 | Woolley et al. | 273/173 |
| 3,863,932 | 2/1975 | Lezatte | 273/169 |
| 4,085,934 | 4/1978 | Churchward | 273/171 |
| 4,367,878 | 1/1983 | Schmidt | 273/175 |
| 4,420,156 | 12/1983 | Campau | 273/169 |
| 4,471,961 | 9/1984 | Masghati et al. | 273/175 |
| 4,498,672 | 2/1985 | Bulla | 273/169 |
| 4,568,088 | 2/1986 | Kurahashi | 273/167 K |
| 4,655,458 | 4/1987 | Lewandowski | 273/170 |
| 4,681,322 | 7/1987 | Straza et al. | 273/173 |

FOREIGN PATENT DOCUMENTS

| | | | |
|---|---|---|---|
| 589696 | 7/1955 | Canada | 273/167 F |
| 267755 | 3/1927 | United Kingdom | 273/173 |

OTHER PUBLICATIONS

Maltby, Ralph, *Golf Club Repair in Pictures*, OH, Ralph Maltby Enterprises, Inc., 1980, pp. 62–64, 70–72, 95.

Cochram et al., *The Search for a Perfect Swing*, Golf Society of Britain, 1968, pp. 2–7, 112–120, 121–127, 144–156, 204–218.

*Primary Examiner*—Edward M. Coven
*Assistant Examiner*—Sebastiano Passaniti

[57] ABSTRACT

A wood golf clubhead assembly is provided having a substantial metal swingweight, located approximately parallel to the flat striking face, within a peripheral groove and bonded therein with adhesive. The new metal swingweight extends to the contour of the wood clubhead and is made to incorporate peripheral weight distribution, including heel and toe, as desired.

4 Claims, 3 Drawing Sheets

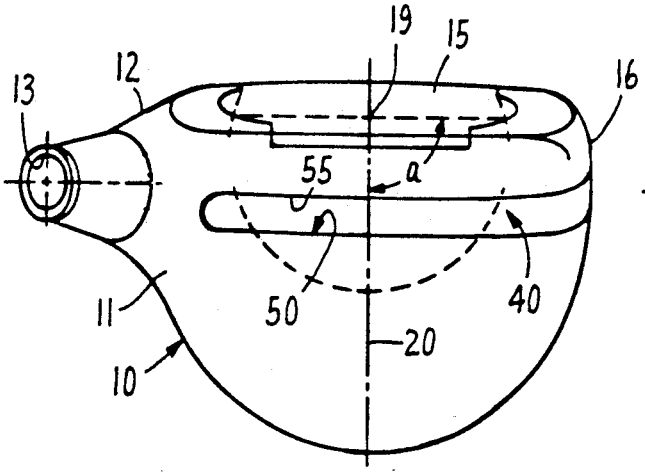
Fig 1(a)
Fig 1(c)
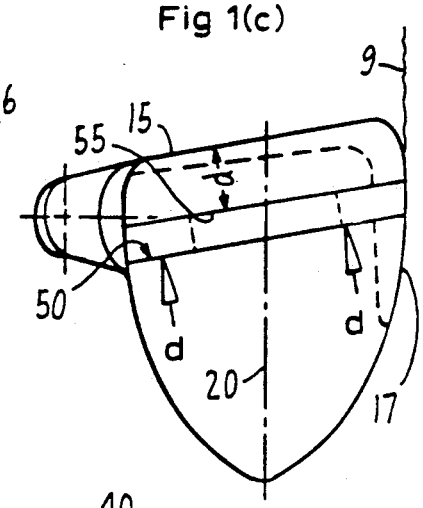
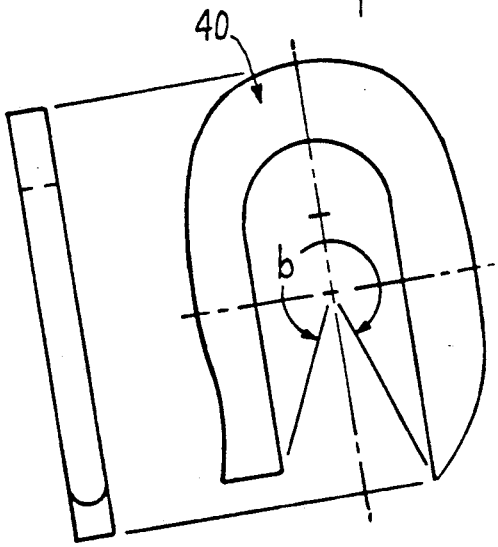
Fig 1(d)
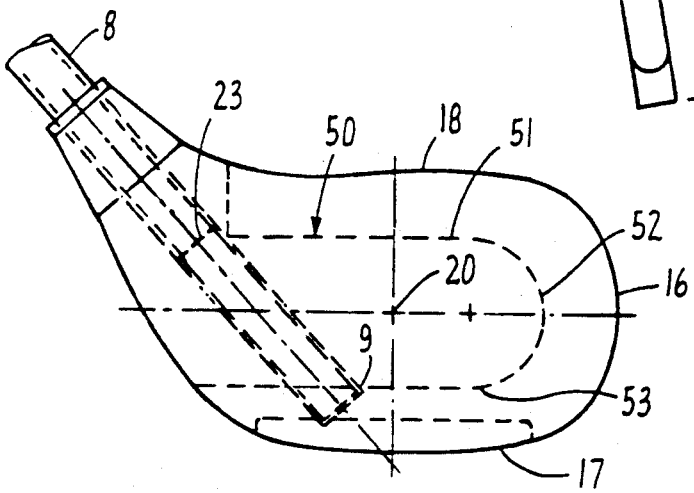
Fig 1(b)

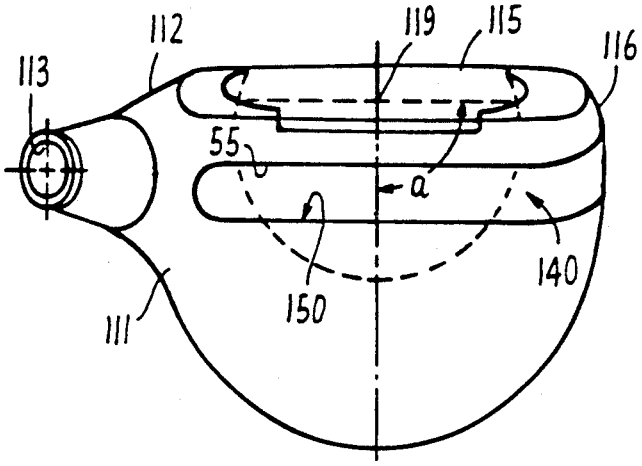
Fig 2(a)
Fig 2(c)
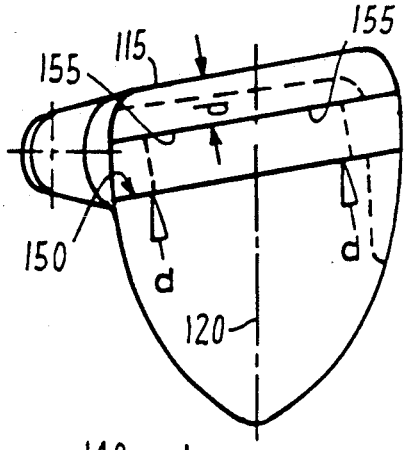
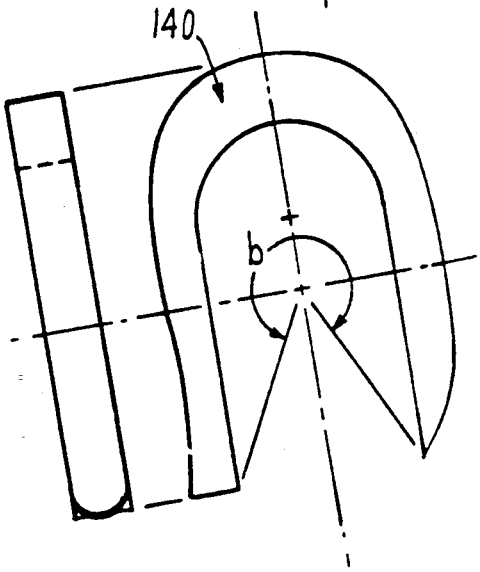
Fig 2(d)
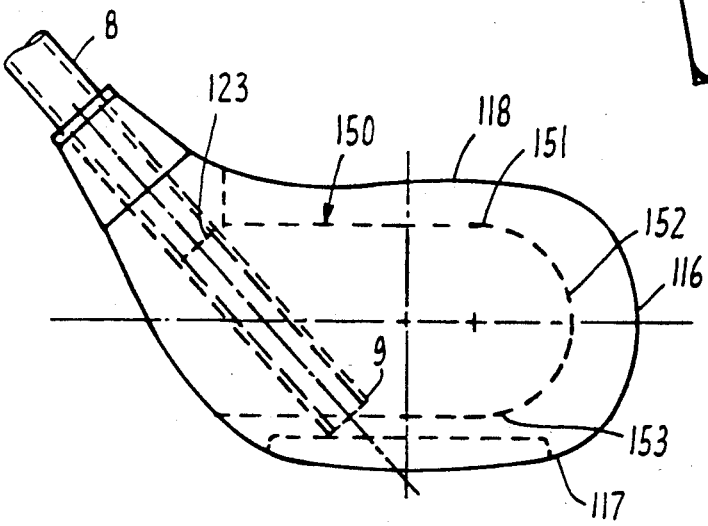
Fig 2(b)

Fig 3(c)
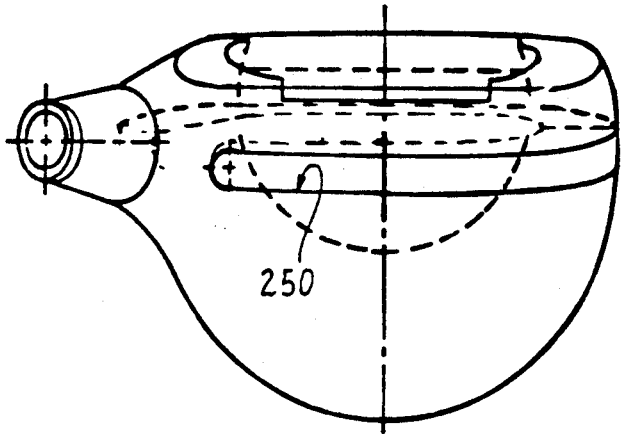
Fig 3(a)
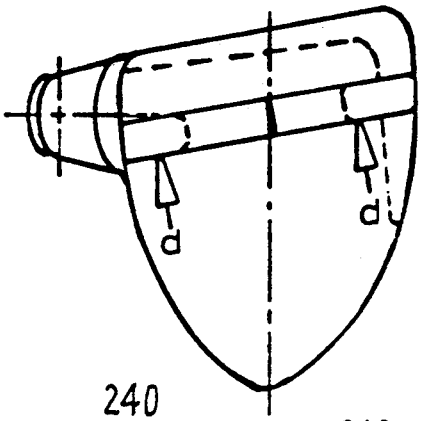
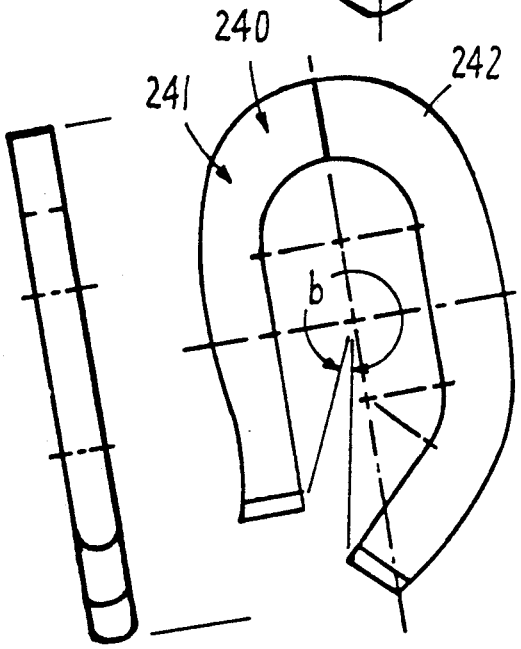
Fig 3(d)
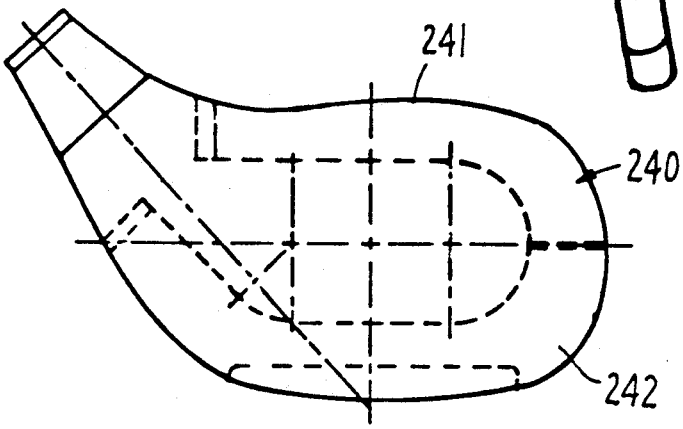
Fig 3(b)

WOOD GOLF CLUBHEAD ASSEMBLY WITH PERIPHERAL WEIGHT DISTRIBUTION AND MATCHED CENTER OF GRAVITY LOCATION

This application is a continuation-in-part of U.S. patent application Ser. No. 629,699 filed Dec. 17, 1990, and now abandoned and Ser. No. 351,835 filed May 15, 1989 and now abandoned.

BACKGROUND OF THE INVENTION

In the present design of most wood golf clubs, excessive side spin is generated to the ball on all off-center hits on the clubface. This characteristic is usually called gear-effect and is inherent in wood golf clubs, in which the lead swingweight is installed too far from the face of the clubhead and without due consideration for good weight distribution in the clubhead assembly.

The lead swingweight usually is installed in a round cavity, drilled in the bottom or sole of the wood clubhead, peened and expanded to secure it in place, and then covered by a metal sole plate.

Considering the high impact forces, lead does not have the structural properties desired for this application and may be an energy absorbing component of the clubhead.

Bulge radius is used on the face of wood clubheads to send the golf ball further off the target line to correct for the excessive part of the gear-effect curve, and the ball will land on the fairway but with some loss in distance.

Improper weight distribution and incorrect center of gravity location in the wood clubhead assembly require the use of bulge radius to correct for these deficiencies in the wood clubhead design.

SUMMARY OF THE INVENTION

This invention relates to golf clubs and specifically to wood golf clubs designed to obtain optimum distance and accuracy for center and off-center hits on the clubface.

The new wood clubhead requires that the size and weight of the wood clubhead be controlled to allow for a substantial swingweight to be added to the wood clubhead assembly in order to improve the weight distribution. The usual lead swingweight was changed to a brass swingweight and can be made in several configurations in order to obtain various weight distributions as desired in golf clubs. For the clubhead size and shape shown full size in FIGS. 1, 2 and 3, the new brass swingweight, and the adhesive to bond it in place, contribute about one-half of the total clubhead weight. The swingweight is made to incorporate the clubhead weight distribution desired. Then it is located, installed and bonded in the clubhead to obtain the center of gravity of the clubhead assembly necessary to control the side spin component on the golf ball for all off-center hits, using a flat clubface.

BRIEF DESCRIPTION OF THE DRAWINGS

The clubhead assembly shown in FIG. 1 incorporates peripheral weight distribution.

FIG. 1(*a*) is the view looking down.

FIG. 1(*b*) is the view looking forward.

FIG. 1(*c*) is the view looking toward the toe of the clubhead .

FIG. 1(*d*) shows the plan view and side view of the 0.25 inch wide swingweight and additional swingweight [see FIG. 1(*b*)] when necessary within the bottom end of the shaft.

The clubhead assembly shown in FIG. 2 is a design for a deep-faced clubhead and favors heel, toe and sole weight distribution.

FIG. 2(*a*) is the view looking down.

FIG. 2(*b*) is the view looking forward.

FIG. 2(*c*) is the view looking toward the toe of the clubhead.

FIG. 2(*d*) shows the plan view and side view of the 0.37 inch wide swingweight and additional swingweight [see FIG. 2(*b*)] when necessary within the bottom end of the shaft.

The clubhead assembly shown in FIG. 3 may incorporate maximum peripheral weight distribution.

FIG. 3(*a*) is the view looking down.

FIG. 3(*b*) is the view looking forward.

FIG. 3(*c*) is the view looking toward the toe of the clubhead.

FIG. 3(*d*) shows the plan view and side view of the two part swingweight.

DETAILED DESCRIPTION OF THE DRAWINGS

Referring to the drawings, FIG. 1(*a*) shows a golf clubhead assembly shown generally as 10. The clubhead assembly 10 includes a wooden blank 11 and a metallic swingweight 40. A heel portion 12 of the clubhead is adapted to receive a club shaft through cylindrical bore 13. A generally flat clubface 15 extends from heel 12 to toe portion 16. A sole portion 17 forms the bottom of the clubhead assembly 10. The top 18 of the clubhead is a smooth, convex surface generally found in wooden clubheads.

The clubhead assembly 10 has a longitudinal axis 20 which extends horizontally as shown best in FIG. 1(*c*) when the clubhead is positioned with the sole portion 17 lying on the ground 9. As shown best in FIG. 1(*a*), the longitudinal axis 20 extends through the center 19 of clubface 15. Longitudinal axis 20 forms a right angle a with clubface 15 when viewed from above as in FIG. 1(*a*).

A generally U-shaped peripheral groove 50 is formed in the outer surface of the clubhead in the top portion 18, toe portion 16 and sole surface 17 of the clubhead. As shown best in FIG. 1(*b*), peripheral groove 50 has a first portion 51 extending along the top surface 18, a second portion 52 extending along the surface of toe portion 16 and a third portion 53 which extends along the sole portion 17 of the clubhead 11.

As shown in FIG. 1(*b*), peripheral groove 50 subtends an angle around the longitudinal axis 20, which extends vertically out of FIG. 1(*b*), of approximately 320 degrees. I have found that the clubhead assembly of my invention will perform adequately if the angle subtended is at least 270 degrees. This angle is shown best in FIG. 1(*d*) as "b."

As an optional feature, a brass rod 23 may be inserted into the bottom end 9 of tubular shaft 8; shaft 8 is carried by cylindrical bore 13 in the heel of the clubhead. Brass rod 23 forms a part of the swingweight to provide a full 360° of peripheral weighting around axis 20, as shown best in FIG. 1(*b*).

A brass swingweight 40 is provided which is carried by peripheral groove 50, as shown in FIG. 1(*a*). In the embodiment shown in FIG. 1, the swingweight 40 is a single piece of brass and is simply slipped into peripheral groove 50 and held securely in place in peripheral groove 50 by epoxy cement.

Swingweight 40 comprises 50% of the weight of the clubhead assembly 10. By weighting the clubhead as shown, I have greatly increased the resistance of the clubhead assembly to rotation of the clubhead caused by off-center hits. I refer to this feature herein as increasing the "mass moment of inertia" of the clubhead. The mass moment of inertia about the vertical axis of rotation is a direct measure of the stability and playability of the golf clubhead assembly. The mass moment of inertia is maximized by locating as much mass of swingweight 50 as possible at the heel and toe of the clubhead, and by not locating the swingweight 50 on the longitudinal axis 20. I have maximized the rotational resistance of the clubhead assembly to off-center hits by placing the swingweight as far as possible away from the longitudinal axis 20.

In the embodiment shown in FIG. 1, the front edge 55 of peripheral groove is set back from clubface 15 a distance "d" as shown in FIG. 1(*c*) of 0.45 inches. I have found that the setback of the front edge 55 of the peripheral groove varies somewhat depending upon the overall size of the wooden clubhead blank 11, and the width of the swingweight, as the two items control the matched center of gravity distance from the clubface. The center of gravity distance is determined by driving range tests in order to obtain the matched center of gravity distance necessary to control gear-effect for the size and weight of a particular clubhead assembly. I have found that the setback for a clubhead shaped as shown in FIG. 1 is optimally 0.45 inches but may be in the range of 0.2 to 0.8 inches.

As shown in FIG. 1(*c*), the plane of peripheral groove 50 is parallel with clubface 15. Although it is preferable to have peripheral groove 50 parallel with clubface 15 as shown, peripheral groove 50 may be formed at up to a 15° angle with clubface 15. As used in the claims herein, the phrase "generally parallel" means within plus or minus 15°.

The drawings show flat clubfaces, i.e., with no bulge or roll radii. My invention will work with "generally flat" clubfaces which have bulge and/or roll radii, but it is preferable to eliminate bulge and roll.

FIG. 2 shows a second embodiment of the invention wherein the reference numerals of FIG. 1 are all increased by 100. The embodiment shown in FIG. 2 incorporates a swingweight 140 which is wider and does not extend as deeply into the wooden blank 111.

FIG. 3 shows a third embodiment of the invention wherein a two-part swingweight is incorporated and wherein the angle "b" subtended by peripheral groove 250 and swingweight 240 is approximately 350°, as shown in FIG. 3(*d*). The two-piece swingweight is shown best in FIG. 3(*d*) as comprising a first or upper section 241 and a second lower portion 242, also shown in FIG. 3(*b*).

I have found that it is generally preferable to size the swingweight so that the swingweight comprises 50% of the total clubhead assembly weight. Although 50% is the preferred weighting, I have found that the clubhead assembly will perform adequately when the swingweight comprises 40% to 60% of the total weight of the combined clubhead assembly.

Each swingweight, after bonding in a correctly located peripheral groove, is then finished to the same contour and surface finish as that of the wood clubhead assembly.

Various widths of swingweights may be used to achieve the degree of peripheral weighing desired. The maximum degree of peripheral weighing requires a wide swingweight, installed and bonded in a correspondingly wide but shallow peripheral groove. As shown in the applicable views in FIGS. 1, 2 and 3, the face and sole areas are spotfaced (approximately 2 inch diameter) to a suitable depth and then filled and reinforced with an equal thickness of epoxy, or a combination of metal and epoxy to obtain the necessary strength, durability and ease of repair for those areas.

The desirable features of this wood clubhead design are:

1. The primary feature is the brass swingweight which is made to incorporate peripheral weight distribution and various degrees of heel and toe, and sole weight distribution, as desired.

2. The excessive gear-effect of wood golf clubs is controlled in this design by correctly locating the appropriate swingweight in the wood clubhead assembly in a peripheral groove of proper width and depth to accommodate the swingweight at the correct distance from the flat clubface.

3. The control of the gear-effect is achieved only to the extent that allows for a flat clubface. This eliminates the use of bulge radius which was only used to correct the starting direction of the golf ball due to excessive gear-effect.

4. A simple design of wood golf clubhead is made from conventional wood blanks such as laminated maple, persimmon, etc. The laminated wood blanks may be made to include the swingweight during the manufacturing of the wood blanks, or to provide the space for installing the swingweight.

5. The clubhead is designed to withstand an impact collision with a standard golf ball to 130 mph.

6. This wood clubhead design is adaptable for any wood golf club from driver to fairway woods with loft up to 50 degrees or more.

7. The clubface is flat (infinite bulge radius) and a good reference for aiming while addressing the golf ball.

8. The flat face of the clubhead is a basic reference in production for tooling and manufacturing.

9. Approximately a two-inch diameter of the impact area on the wood clubface is reinforced and protected by a layer of epoxy and/or other suitable material.

10. The sole area of the wood clubhead assembly is reinforced and protected by a layer of epoxy and/or other suitable material as desired.

11. Final swingweighting of the wood clubhead assembly is accomplished by adding or removing epoxy in the sole area and adding balance weight within the bottom end of the golf club shaft as needed.

12. Other suitable materials in addition to wood, brass, epoxy and epoxy resin may be used in this clubhead design.

The impact ballistics of golf is covered in detail in the book *The Search for the Perfect Swing*, Section 6.

The information on that subject pertinent to the applicant's wood golf club design follows:

During contact with the golf ball, for a 100 mile per hour speed, the clubhead is considered a free body. It will decelerate and rotate slightly about its center of mass when the ball is impacted on an area not through the clubhead center of gravity.

The compression force on the ball due to its inertia and the kinetic energy of the clubhead at 100 mph, averages about 1,400 pounds for a contact distance of about 0.75 inch, during a time interval of only about 0.0005 second.

The golf ball is compressed and deformed such that the diameter of contact on the clubface is about 1.00 to 1.25 inch, depending on the hardness or compression rating of the ball.

Due to its resilience (Coefficient of Restitution), the ball instantly regains its round shape and pushes off the clubface to attain a speed of approximately 135 mph.

When the face of the clubhead is not normal or 90 degrees to a line through the center of mass of the deformed ball during impact, the effective loft angle of the clubface will cause a spin on the ball as it leaves the clubface.

The contact area between the ball and the clubface varies from zero to about one square inch and back to zero in about 0.0005 second. The contact force and reaction varies from zero to a maximum of about 2,000 pounds, back to zero.

The friction between the ball and the clubface is about one fifth of the normal reaction force. It is evident that very little sliding action between the clubface and the golf ball will occur.

For all off-center hits some clubhead rotation occurs and the appreciable friction between the ball and the clubhead causes spin on the golf ball. The back spin is caused by the loft angle of the clubhead, and the clubhead rotation generates a small horizontal component to the total back spin. The resulting horizontal curve is usually referred to as gear-effect and is caused by off-center hits.

The pure back spin of the ball in the vertical plane is caused by the loft angle on the clubface. The back spin occurs due to the high friction between the ball and the clubface, and because the inertia of the ball and the loft angle of the clubhead do not allow the deformed ball to push back on the fast moving clubface with a resultant that is in line with its own center of mass and, also, normal or ninety degrees to the clubface.

Due to the large reaction forces involved, a small moment arm results in a high spin rate.

Bulge radius on the clubface is a horizontal loft angle and averages about three degrees of side loft, at one inch distance from the sweet spot.

For off-center hits at 100 mph, the golf ball average reaction of 1,400 pounds on the face of the clubhead assembly decelerates the clubhead to about 69 mph and at the same time causes a slight instant rotation of the clubhead about its own center of gravity.

The degree of clubhead rotation is dependent on the force of impact, the distance from the center of gravity and the mass-moment of inertia of the clubhead assembly about the axis of rotation. The axis about which the clubhead rotates may be different with each hit because the center of the reaction force of the golf ball on the face of the clubhead may not be through the center of gravity and can be any place on the clubface.

For on-center hits, the golf ball absorbs about 42 percent of the total kinetic energy of a 100 mph clubhead speed to attain a speed of about 135 mph.

Off-center hits on the clubface are less efficient and some additional energy is absorbed to rotate the clubhead and to generate side spin on the ball. Additional energy loss is also due to the vibration in the golf shaft, loose lead swingweight, etc.

The golf clubhead assembly will rotate about a vertical axis a small amount, for all impact with the golf ball, except for hits in a vertical plane through the clubhead center of gravity.

Hits on the clubface directly above and below the center of gravity will not generate side spin but will only effect the back spin on the ball. The amount depends on the impact force, the moment art about the center of gravity, and the horizontal mass-moment of inertia of the clubhead assembly.

Considering the impact ballistics discussed herein, the wood clubhead design shown in FIGS. 1, 2 and 3 are the best compromises to effectively control the side spin or gear-effect of wood golf clubs.

This control allows the use of a flat clubface and eliminates the need to use bulge radius to obtain directional control.

This wood clubhead design, in addition to controlling the side spin to the minimum required for accuracy, incorporates peripheral weight distribution in the swingweight and minimizes the need to use roll radius on the clubface.

The shape of the improved wood golf clubhead assembly is approximately symmetrical except for the loft angle, and streamlined for appearance and to minimize air drag.

There is an optimum location for the center of gravity, measured from the clubface, for each design of golf clubhead assembly.

The distance the center of gravity should be from the clubface varies directly as the mass-moment of inertia of the clubhead assembly about the vertical axis through the center of gravity.

The distance of the center of gravity to the face of the clubhead is the moment arm about which the clubface rotates for all off-center impact with the ball, which causes the side-spin component on the golf ball, usually called gear-effect.

The correct center of gravity location for the wood clubhead assembly reduces the excessive side spin to the minimum required to just curve the golf ball back to the target line for off-center hits on a flat clubface.

The correct center of gravity location for any design of golf clubhead can be determined by actual tests at the driving range, using test golf clubs in which the only variable is the location of the swingweight, measured from the clubface.

The corresponding center of gravity of each test golf clubhead assembly was determined on a special knife edge balance fixture before the golf shaft was permanently installed and bonded to the clubhead.

Tests to determine the best center of gravity location for each clubhead design were simple and done at the local driving range.

The range golf balls were used for the tests. Each ball was marked with a one-quarter inch diameter black ink mark with a felt marking pen.

The test ball was teed up in the normal position with the ink dot facing back toward the face of the golf club at the address position.

Tests were made using No. 1 wood clubs, each with a smooth flat face. The clubs were used in the normal manner in an effort to achieve about 200 yards, including roll, for on-center hits. Off-center hits resulted in less distance.

After each hit, the starting direction, the curve or flight of the ball, and its landing position relative to the target line, were noted. Then the clubface was inspected and the location of the ink imprint from the ball was noted.

The transfer of the one-quarter inch ink dot from the ball showed the exact center of impact for each hit on the clubface.

After the data was noted and recorded, the ink imprint was removed from the clubface.

For each club tested, the above procedure was repeated until all areas of the clubface were impacted to obtain a definite trend on the directional control of each golf club.

The center of gravity or sweet spot was easily determined and was based on accuracy, distance and the sound of impact of each hit.

Off-center hits were made to one inch from the sweet spot. Results showed good accuracy and distance for the golf clubs with compatible center of gravity locations.

However, the optimum center of gravity location was difficult to determine accurately because the design has good weight distribution and allows for a fairly wide range of acceptable center of gravity locations.

The weight for the size and shape of the laminated maple clubhead assembly shown full size in FIG. 1 and the brass swingweight in FIG. 1(*d*) bonded in place to complete the clubhead totals 7.4 ounces. The center of gravity of the clubhead assembly before the golf shaft was installed was 0.76 inch from the face of the clubhead. After the new design of wood golf clubs was tested at the driving range, the better performing clubs with known center of gravity locations (0.65, 0.76 and 0.84 respectively) were selected for further comparison tests with three different brands of wood golf clubs purchased at a local golf supply store.

Using No. 1 clubs, the tests were conducted on three clubs of each design. All the clubs performed well for on-center hits and obtained about the same distance and accuracy.

However, for off-center hits the new designed clubs claimed herein were more accurate and obtained greater distance for all off-center hits.

The tests conducted to date are elementary but done in a basic way that golfers can understand. If required at a later date, precise testing can be contracted out of considerable expense, using a mechanical golf ball striker such as Iron Byron.

Also, the design characteristics of the currently approved golf balls should be considered in regard to their spin characteristics when selecting golf balls to be used for more precise tests.

More precise and costly testing is more applicable for a design that is to be finalized for manufacturing for sale to the public.

All of the test clubs with various center of gravity locations are available to demonstrate and verify the test results claimed in this patent application.

What is claimed is:

1. In a golf clubhead assembly wherein a wooden clubhead has a heel portion adapted to receive a tubular club shaft, a generally flat clubface extending from said heel to a toe portion, a sole forming the bottom of said clubhead, and a smooth, convex surface forming the top of said clubhead, and wherein said clubhead assembly has a longitudinal axis extending horizontally from said heel to said toe portion through the vertical center of said clubface, the improvement comprising:

a generally U-shaped continuous peripheral groove formed in an outer surface of the clubhead along the top, portion toe and the sole and extending inwardly into said clubhead, said peripheral groove lying in a plane generally parallel with the plane of said clubface, a swingweight insertable within and carried by said peripheral groove, the weight of said swingweight comprising 40% to 60% of the total weight of said clubhead assembly, said swingweight subtending an arc of at least 270 degrees about said longitudinal axis, and means for holding said swingweight securely in said peripheral groove.

2. The apparatus of claim 1 wherein said peripheral groove is set back from said clubface a distance of 0.2 to 0.8 inches.

3. The apparatus of claim 1 wherein said clubface is flat and has no bulge or roll radius.

4. The apparatus of claim 1 wherein said wooden clubhead has a cylindrical bore in said heel, and wherein said tubular club shaft is carried by said cylindrical bore, and further comprising a brass rod carried by said tubular shaft, whereby said brass rod is a portion of the swingweight and said swingweight subtends an arc of 360 degrees about said longitudinal axis.

* * * * *

UNITED STATES PATENT AND TRADEMARK OFFICE

CERTIFICATE OF CORRECTION

PATENT NO. : 5,076,585

DATED : December 31, 1991

INVENTOR(S) : Harry Bouquet

It is certified that error appears in the above-identified patent and that said Letters Patent is hereby corrected as shown below:

Col. 8, between lines 2 and 3, insert the following paragraph:

--The simple basic driving tests made to date should be sufficient to justify the design principles claimed in this patent application.--.

Col. 8, line 21, delete "portion toe" and insert --the toe portion--.

Signed and Sealed this

Thirteenth Day of April, 1993

*Attest:*

*Attesting Officer*

STEPHEN G. KUNIN

*Acting Commissioner of Patents and Trademarks*